United States Patent [19]

Shelby et al.

[11] 4,195,480

[45] Apr. 1, 1980

[54] MANIFOLDED MULTIPLE HYDRAULIC PUMP STRUCTURE

[75] Inventors: Robert L. Shelby, Chillicothe; Bertwin E. Behrends, East Peoria, both of Ill.

[73] Assignee: Caterpillar Tractor Co., Peoria, Ill.

[21] Appl. No.: 4,793

[22] Filed: Dec. 26, 1978

[51] Int. Cl.[2] ..... F15B 13/09

[52] U.S. Cl. ..... 60/486; 60/DIG. 10; 418/200

[58] Field of Search ..... 418/200; 60/486, 458, 60/DIG. 10

[56] References Cited

U.S. PATENT DOCUMENTS

| | | | |
|---|---|---|---|
| 2,751,846 | 6/1956 | Lapsley | 418/200 X |
| 3,101,673 | 8/1963 | Clark et al. | 418/200 X |
| 3,314,369 | 4/1967 | Yonei et al. | 418/200 |

*Primary Examiner*—Edgar W. Geoghegan
*Attorney, Agent, or Firm*—Wegner, Stellman, McCord, Wiles & Wood

[57] ABSTRACT

An improved hydraulic pump structure for hydraulic systems which require a plurality of rotary pumps has a pump casing assembly (20) consisting of a plurality of pump casing elements (23–29) which are fastened together in abutting relationship to define a first pump cavity (54) and a second pump cavity (55*a*) with aligned drive shaft holes (56–61) and a drive shaft (62–63) which is journalled in the holes (56–61) and carries a rotary pump member (76–77 or 80–81) in each cavity (54 and 55*a*). The casing elements (23–29) are manifolded to provide a first fluid inlet passage (82), a first fluid delivery passage (84) which terminates in a port in a fluid delivery end plate (29), a second fluid inlet passage (86) which has an entrance opening (H6) in the fluid delivery end plate (29), and a second fluid outlet passage (87) which terminates in a port in the fluid delivery end plate (29). There may be two subassemblies (21 and 22) with two pumps in each, secured together in face abutting relationship with an axially interengaged driving connection (62*a*–63*a*) between drive shaft segments (62 and 63) in the two subassemblies (21 and 22) and with fluid delivery passages (83 and 84) extending from one assembly through the other.

19 Claims, 11 Drawing Figures

FIG. 5.
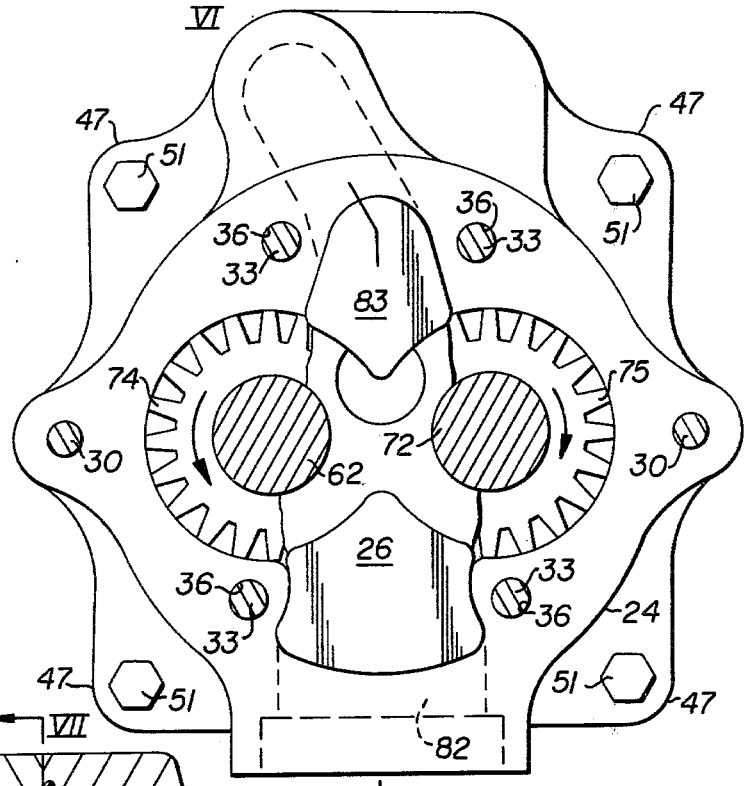
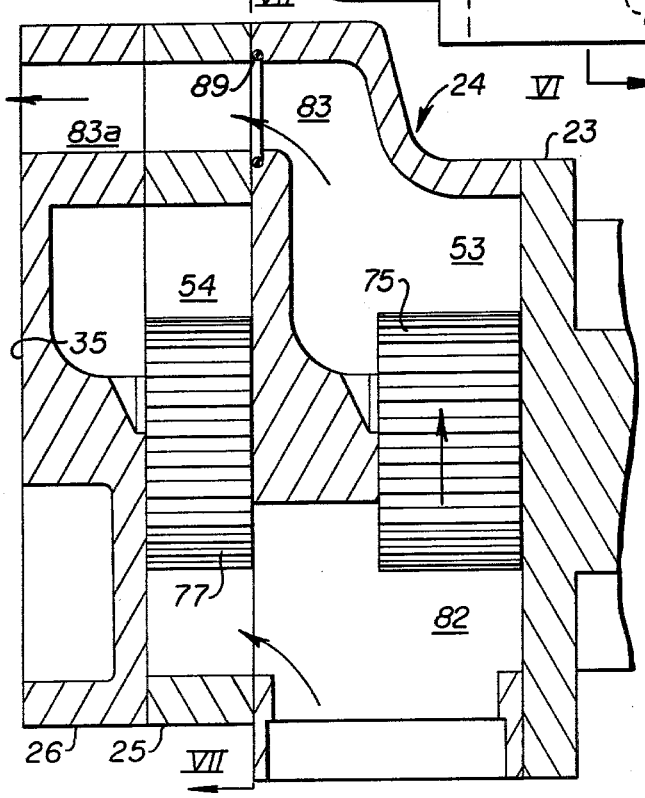
FIG. 6.

FIG. 7.
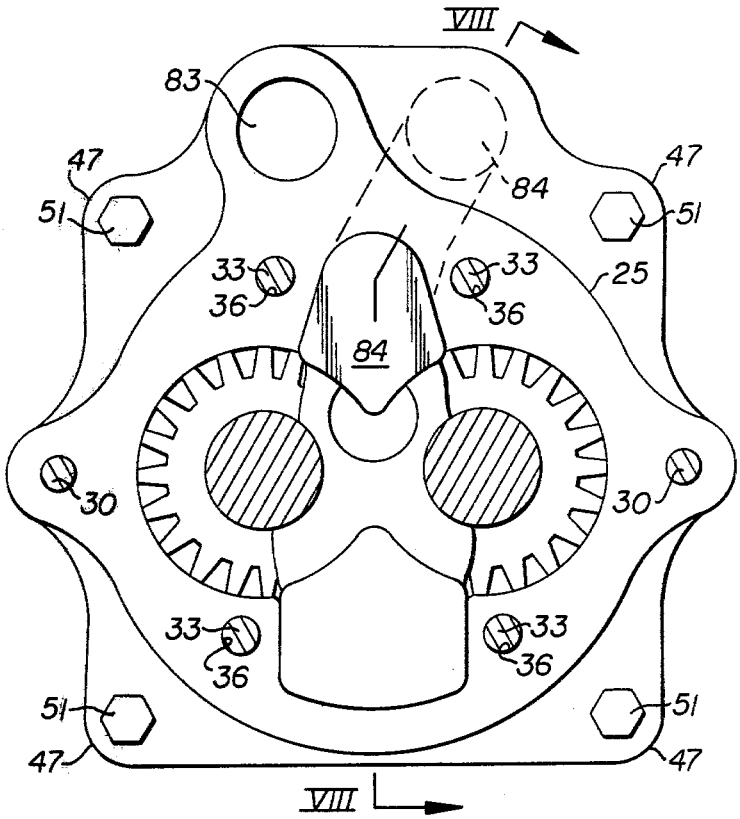
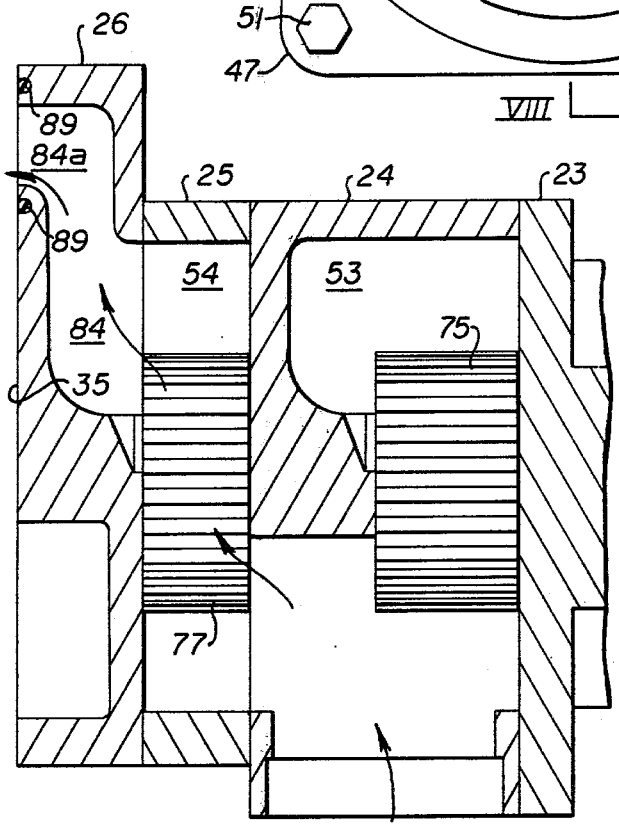
FIG. 8.

FIG. 9.
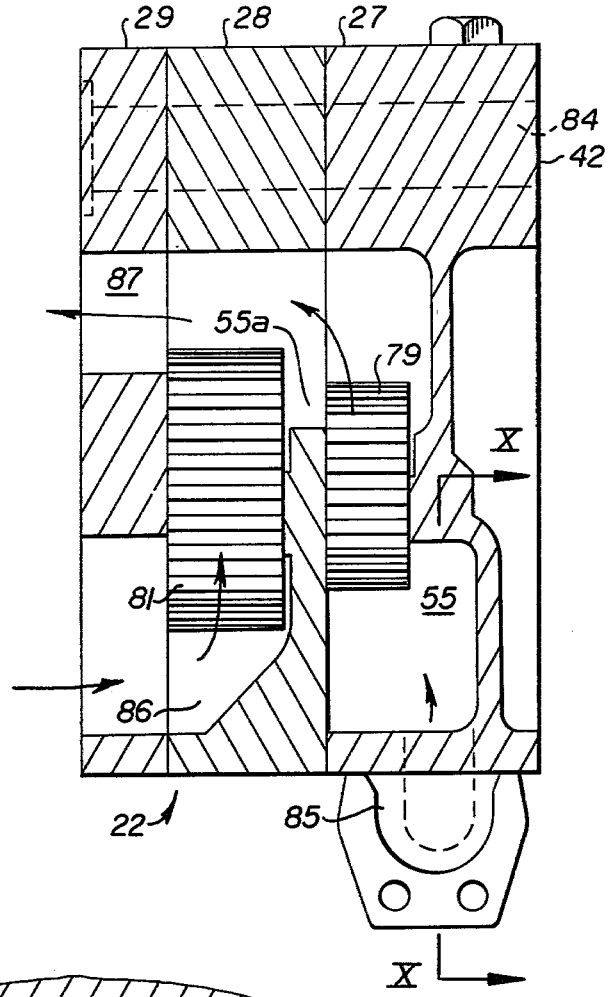
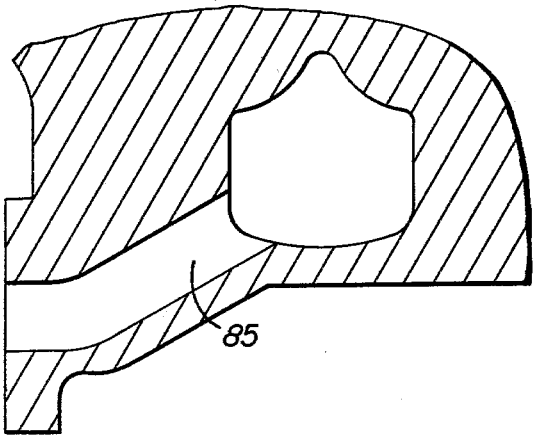
FIG. 10.

MANIFOLDED MULTIPLE HYDRAULIC PUMP STRUCTURE

TECHNICAL FIELD

This invention relates to a manifolded, multiple hydraulic pump structure which may be used wherever two or more rotary pumps may be driven by a single drive shaft. It is expressly disclosed herein as applied to a heavy vehicle having a hydraulic transmission and a hydraulic torque converter; but is not limited to such application.

BACKGROUND ART

There are numerous situations in which a hydraulic power circuit requires a plurality of rotary pumps to supply fluid to various power elements in the system. Commonly such pumps are completely independent of one another, which requires plural mountings and a substantial number of conduits of varying length, all of which are subject to possible leakage at their various connections and to breakage under operating stress. The arrangement of separate pumps, separately mounted, gives very poor space utilization and requires a separate drive train to each of the pumps.

Typical of such hydraulic systems are those in heavy vehicles, such as crawler tractors, wheel loaders, and large capacity dump trucks. Such vehicles commonly have a hydraulic transmission and a hydraulic torque converter. The hydraulic system for such a vehicle requires a charging pump for the hydraulic transmission, a fluid conduit from the pump to the transmission, a charging pump for the torque converter, a fluid conduit from the torque converter charging pump to the torque converter, scavenging pumps, scavenging conduits from the transmission and the torque converter to the scavenging pumps, fluid delivery lines to both charging pumps, and return lines from the scavenging pumps to the sump.

DISCLOSURE OF INVENTION

The present invention is directed to overcoming one or more of the problems as set forth above.

According to the present invention, an improved pump structure has a pump casing assembly consisting of a plurality of rotary pump casing elements disposed in face abutting relationship, with sealing means between the casing elements and means detachably securing the casing elements in assembled, face abutting relationship. The casing elements cooperate to define a first pump cavity and a second pump cavity, with a single drive shaft extending through an opening in a drive end plate of the casing elements and through both pump cavities in each of which it carries a rotary pump member. The casing elements also are provided with a plurality of manifold passages including a first fluid inlet passage for admitting fluid to the first pump, a first fluid delivery passage from the first pump which has a port in a fluid delivery end plate of the casing elements, a second fluid inlet passage and a second fluid outlet passage.

When the invention is applied to a heavy vehicle which has a hydraulic transmission and a hydraulic torque converter, the pump casing elements define a transmission charging pump cavity and a torque converter charging pump cavity with the drive shaft extending through both cavities and a rotary charging pump member in each cavity, the charging fluid inlet passage also supplies the torque converter pump cavity, there is a torque converter charging fluid delivery passage from that pump to a charging fluid port in the fluid delivery end plate, and a second scavenging pump which also has a pump member on the drive shaft.

BRIEF DESCRIPTION OF DRAWINGS

FIG. 5 is a sectional view taken substantially as indicated along the line V—V of FIG. 4;

FIG. 6 is a fragmentary sectional view taken substantially as indicated along the line VI—VI of FIG. 5;

FIG. 7 is a sectional view taken substantially as indicated along the line VII—VII of FIG. 6;

FIG. 8 is a fragmentary sectional view taken substantially as indicated along the line VIII—VIII of FIG. 7;

FIG. 9 is a fragmentary sectional view taken substantially as indicated along the line IX—IX of FIG. 2;

FIG. 10 is a fragmentary sectional view taken substantially as indicated along the line X—X of FIG. 9.

BEST MODE FOR CARRYING OUT THE INVENTION

Figure 1:
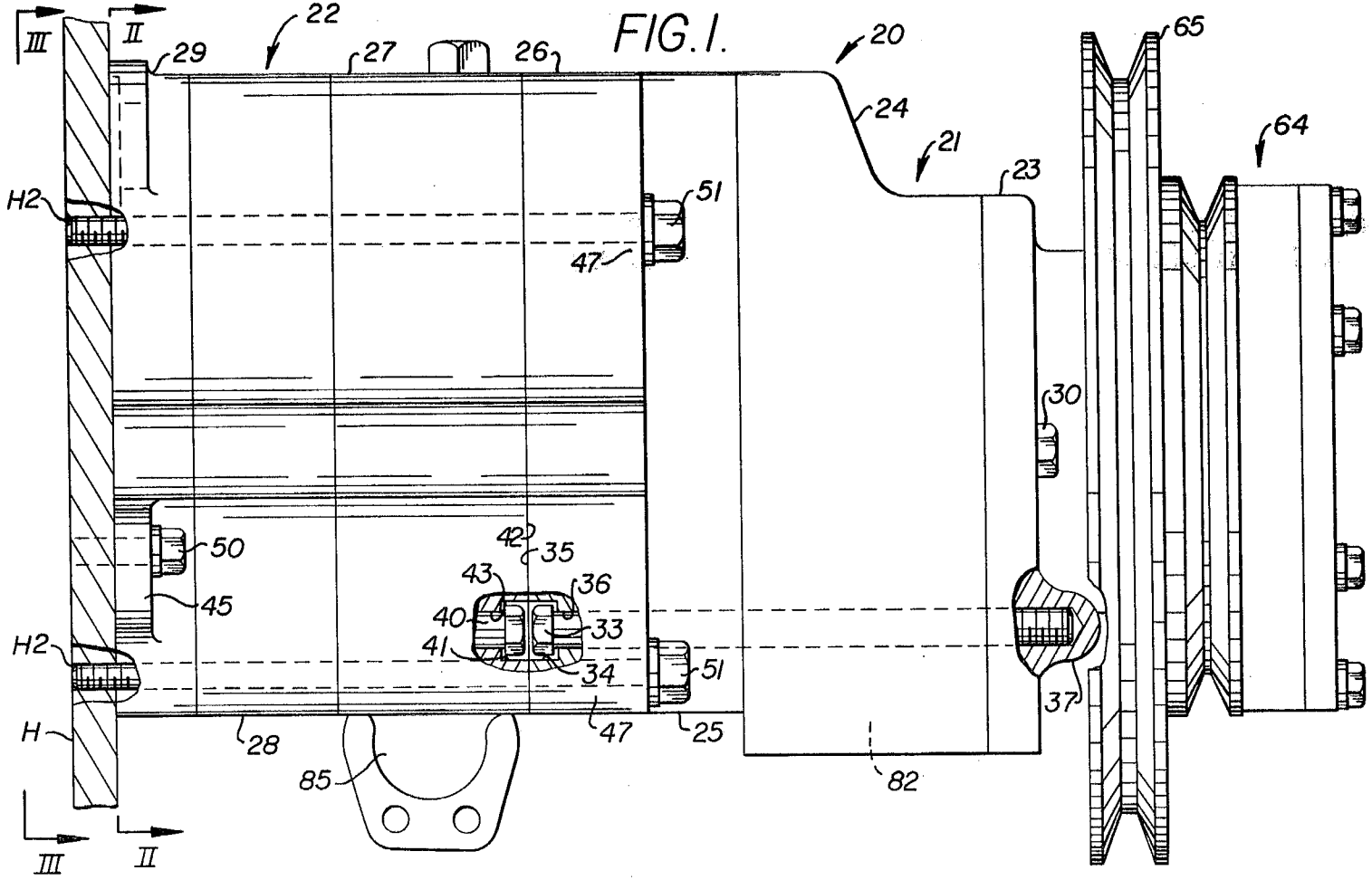
FIG. 1 is a side elevational view of the improved hydraulic pump structure of the present invention, mounted upon a gear housing wall of a heavy vehicle, with parts broken away and illustrated in section.

Referring to FIGS. 1-4 of the drawings, the improved pump structure of the present invention comprises a pump casing assembly, indicated generally at 20, which includes a charging pump subassembly, indicated generally at 21, and a scavenging pump subassembly, indicated generally at 22. The pump casing elements forming the charging pump subassembly include a drive end plate 23 and a first set of casing elements consisting of a torque converter charging pump element 24, a transmission charging pump casing element 25, and a charging subassembly transition casing element 26. The scavenging pump subassembly 22 consists of a second set of casing elements including a scavenging inlet casing element 27, a scavenging pump casing element 28, and a fluid delivery end plate 29.

The casing elements 23-26 of the charging pump subassembly 21 are aligned by means of a pair of alignment pins 30 which make a snug sliding fit in alignment sleeves 31 and screw into threaded bores 32 in the transition casing element 26. Assembly of the charging pump subassembly 21 is by means of four long machine screws 33 which have their heads seated in counterbores 34 in a transition face 35 of the transition casing element 26, and the machine screws 33 extend through aligned bores 36 in the casing elements 24, 25 and 26, and screw into threaded bosses 37 which project from the outer surface of the drive end plate 23.

The three casing elements of the scavenging pump subassembly 22 are aligned with one another and with the charging pump subassembly 21 by means of guide pins 38 in the scavenging inlet casing element 27 and the fluid delivery end plate 29 which seat in sockets 39 in the scavenging pump casing element 28 and in the transition face 35 of the transition casing element 26. The three casing elements of the scavenging pump subassembly 22 are assembled by means of four long machine screws 40 which have their heads recessed in counterbores 41 formed in a front face 42 of the subassembly 22, and the machine screws 40 extend through aligned bores 43 in the casing elements 27 and 28 and screw into threaded bores 44 in the fluid delivery end plate 29.

Figure 2:
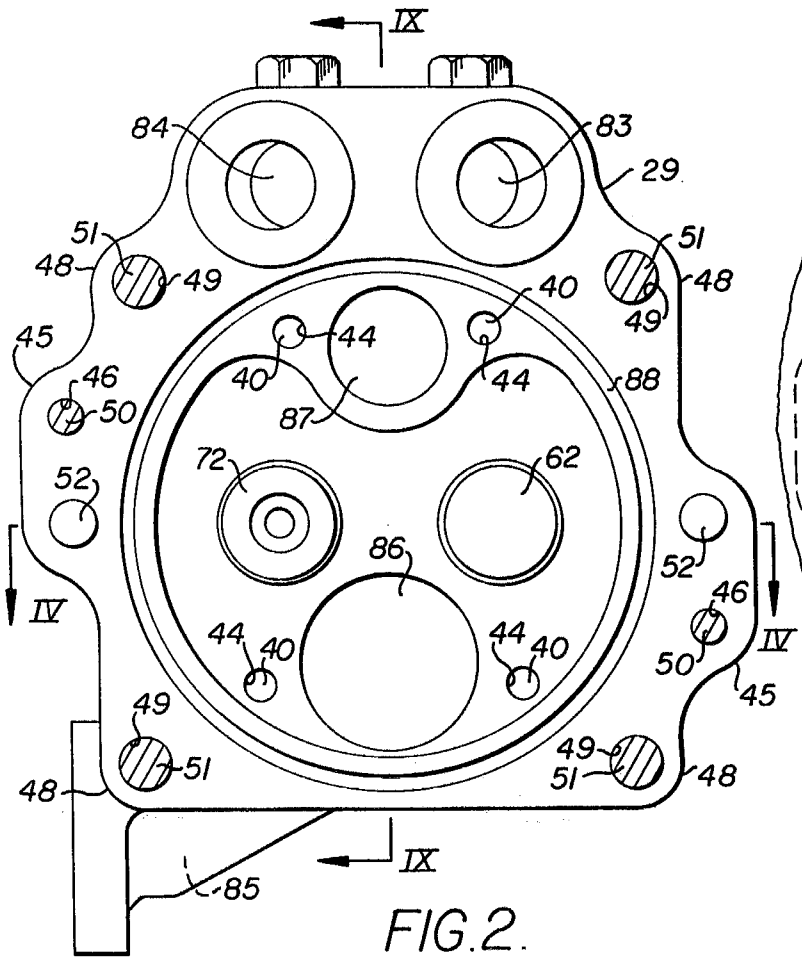
FIG. 2 is an end elevational view illustrating the fluid delivery end of the pump structure, taken substantially as indicated along the line II—II of FIG. 1.

As best seen in FIGS. 1 and 2, the fluid delivery end plate 29 is provided with mounting flanges 45 in which there are bolt holes 46; and there are also four peripheral mounting bosses 47 on the transitional pump casing element 26, and aligned with the bosses 47 on the pump casing elements 27, 28 and 29 are mounting bosses 48, and continuous bolt holes 49 extend through the aligned bosses 47 and 48. The bolt holes 46 and the bolt holes 49 receive mounting bolts 50 and 51, respectively, by means of which the subassemblies 21 and 22 are independently secured to a housing wall H of a bevel gear housing which is a part of the vehicle drive. The housing wall H has threaded holes H1 into which the mounting bolts 50 are screwed to secure the scavenging pump subassembly 22 to the wall H and there are also threaded bolt holes H2 in the wall H which receive the mounting bolts 51 that secure the charging pump subassembly 21 to the wall. In addition to securing the charging pump subassembly 21 to the housing wall H, the threaded bolts 51 also detachably secure the two subassemblies 21 and 22 in face abutting relationship as illustrated in FIG. 1. In addition to the mounting bolts 50, guide pins 52 which are aligned with the guide pins 38 in the fluid delivery end plate 29 seat in holes H3 in the housing wall H.

Figure 4:
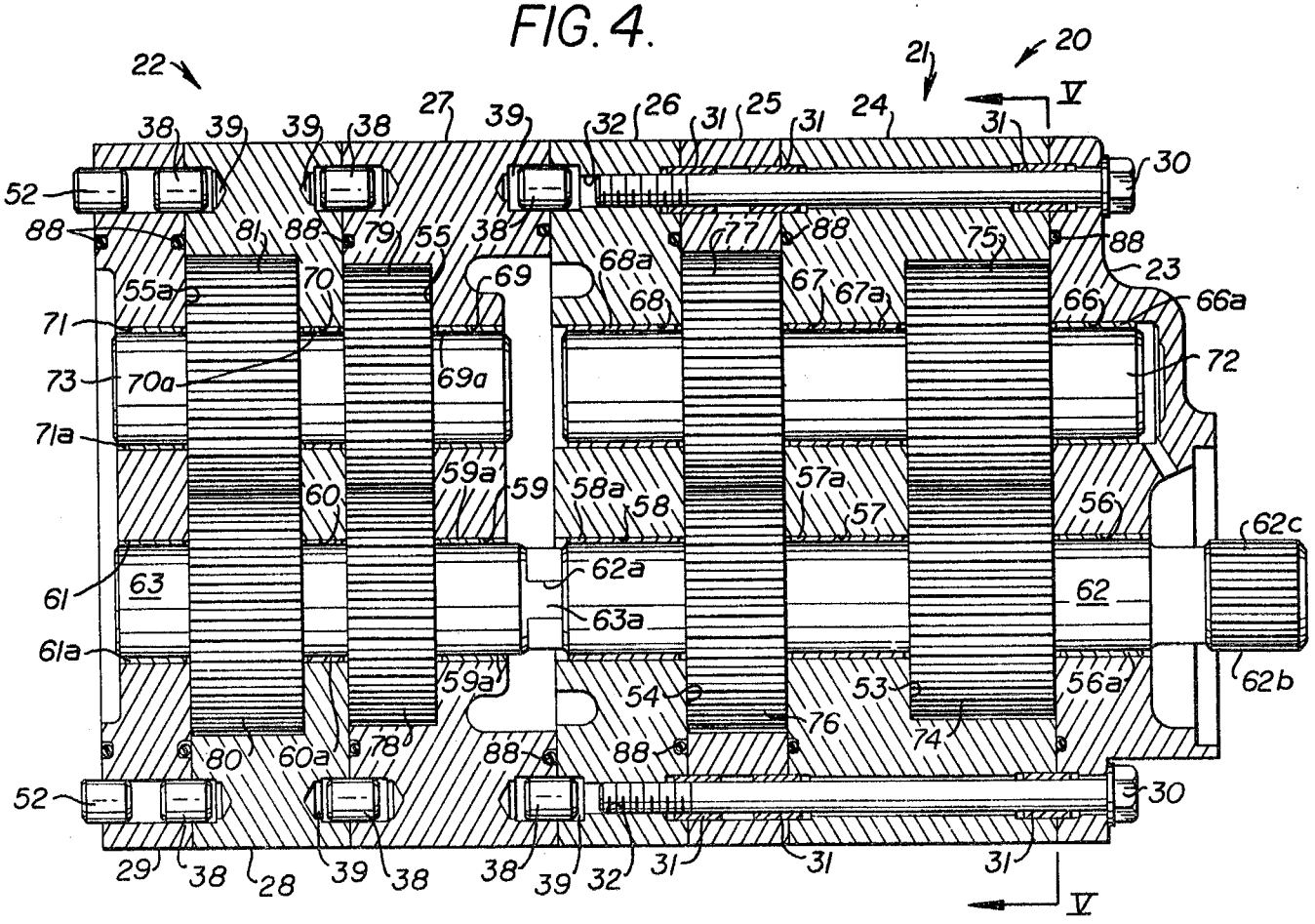
FIG. 4 is a horizontal sectional view taken substantially as indicated along the line IV—IV of FIG. 2.

Referring now to FIG. 4, the pump casing elements 23 and 24 cooperate to define a torque converter charging pump cavity 53; and the casing element 24 also cooperates with casing elements 25 and 26 to define a transmission charging pump cavity 54. The three casing elements of the subassembly 22 cooperate to define scavenging pump cavities 55 and 55*a*. The pump casing elements of the charging pump subassembly 21 are provided with a series of aligned pump drive shaft openings 56, 57 and 58 which are provided with respective sleeve bearings 56*a*, 57*a* and 58*a*; and in the scavenging pump subassembly 22 are aligned pump drive shaft openings 59, 60 and 61 which are provided, respectively, with sleeve bearings 59*a*, 60*a* and 61*a*. A charging pump drive shaft segment 62 is journalled in the sleeve bearings 56*a*–58*a*, while a scavenging pump drive shaft segment 63 is journalled in the bearings 59–61; and the two drive shaft segments have an axially interfitting drive connection provided by a slot 62*a* at the inner end of the drive shaft segment 62 and a lug 63*a* at an end of the drive shaft segment 63 which makes a sliding fit in the slot 62*a*. The drive shaft segment 62 has an end portion 62*b* which extends through the drive shaft opening 56 in the drive end plate 23 which is adapted for operative connection to driving means through a drive pulley assembly, indicated generally at 64, by means of which a drive pulley 65 is mounted upon the drive shaft segment 62 through a splined connection 62*c*. The drive pulley assembly forms no part of the novel subject matter of the present invention, so it is not described in detail.

Alongside the drive shaft openings 56–58 in the charging pump subassembly 21 are idler shaft openings 66, 67 and 68 which are provided with respective sleeve bearings 66*a*–68*a*; and alongside the drive shaft openings 59, 60 and 61 in the subassembly 22 are idler shaft openings 69, 70 and 71 which are provided, respectively, with sleeve bearings 69*a*–71*a*. A charging pump idler shaft 72 is journalled in the sleeve bearings 66*a*–68*a*, while an idler shaft 73 is journalled in the sleeve bearings 69*a*–71*a*.

Keyed to the drive shaft segment 62 and to the idler shaft 72 in the torque converter charging pump cavity 53 are meshing gear pump members 74 and 75 which form a rotary, gear type torque converter charging pump; and on said shafts 62 and 72 in the transmission charging pump cavity 54 are intermeshing gear pump members 76 and 77 which provide a rotary transmission charging pump. Similarly, on the drive shaft segment 63 and the idler shaft 73, in the scavenging pump cavity 55 are intermeshing gear pump members 78 and 79 which provide a first rotary scavenging pump; while intermeshing gear pump members 80 and 81 in the scavenging pump cavity 55*a* provide a second rotary scavenging pump. The first rotary scavenging pump 78–79 scavenges fluid from a torque converter C, while the second rotary scavenging pump 80–81 scavenges fluid from a transmission T.

Referring now particularly to FIGS. 1, 2 and 5–10, the present hydraulic pump structure 20 is manifolded to provide a charging fluid inlet passage 82 (FIGS. 1, 5, 6 and 8); a torque converter charging delivery passage 83 (FIGS. 3, 5, 6 and 7); a transmission charging fluid delivery passage 84 (FIGS. 2, 7 and 8); a torque converter scavenging inlet passage 85 (FIGS. 1, 2, 9 and 10); a transmission scavenging fluid inlet passage 86 (FIGS. 2 and 9); and a scavenging fluid outlet passage 87 (FIGS. 2 and 9).

Figure 3:
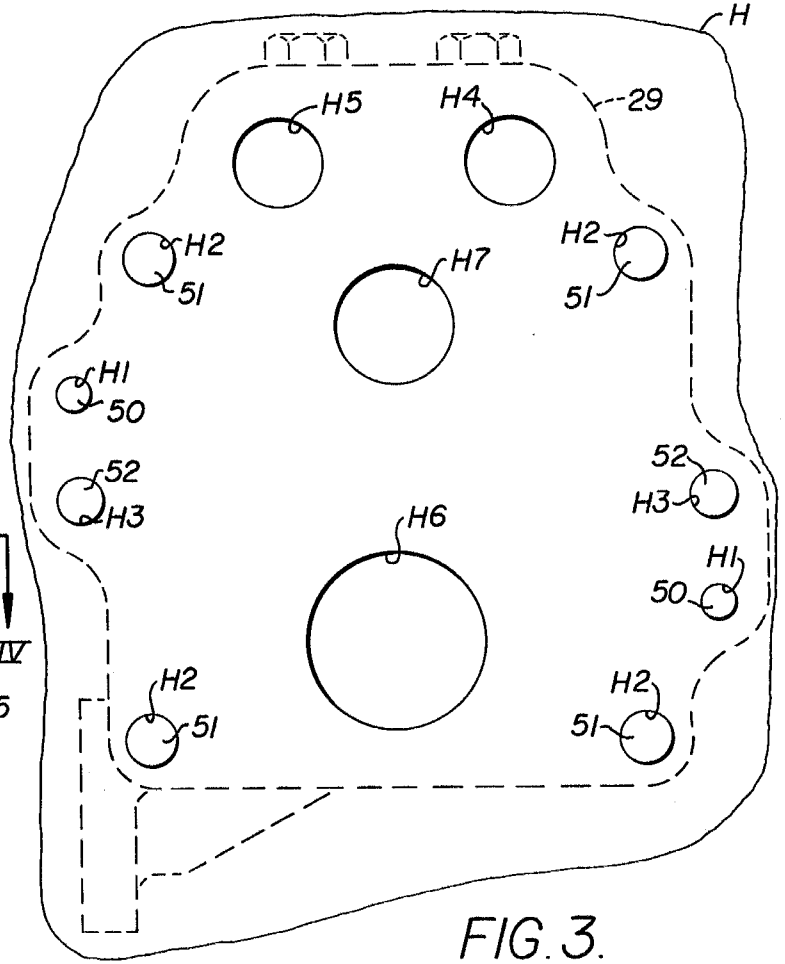
FIG. 3 is an elevational view taken substantially as indicated along the line III—III of FIG. 1.

Because of the fact that the pump structure is mounted on the gear housing wall H with the fluid delivery end plate 29 abutting the wall, the wall is provided with holes which are seen in FIGS. 2 and 3 to be in register with the ports for the passages 83, 84, 86 and 87, and said holes are identified in FIG. 3 by the respective numerals H4, H5, H6 and H7.

When the structure 20 is assembled, annular seals 88, which are mounted in grooves in certain of the casing element faces in abutment with the adjacent casing element faces and with the wall H, seal the entire structure against leakage from the pump cavities. In addition, leakage from the charging delivery passages 83 and 84 is minimized or provided by means of annular seals 89 (see FIGS. 6 and 8) at the abutting faces between the casing elements through which those passages pass.

INDUSTRIAL APPLICABILITY

Figure 11:
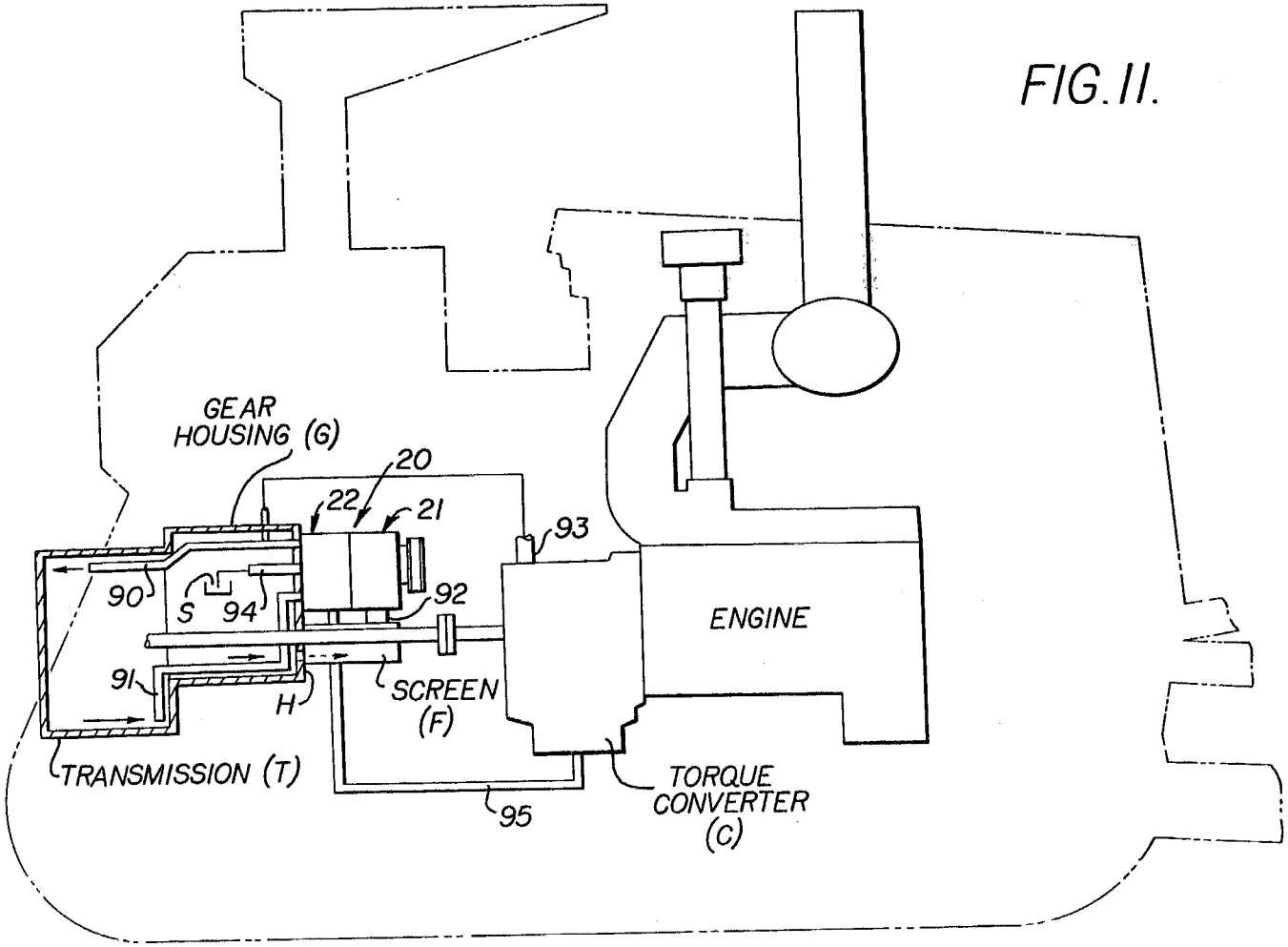
FIG. 11 is a diagrammatic view illustrating the operative relationship between the pump structure of the present invention and functionally related parts of a heavy vehicle power train and hydraulic system.

The improved pump structure 20 of the present invention can be used in any hydraulic system having two rotary pumps that can be driven off the same shaft. A particularly advantageous use is illustrated in FIG. 11, where the pump structure 20 is mounted on a housing wall H of a gear housing G that is in direct communication with the housing for the hydraulic transmission T of a heavy vehicle. This permits a transmission charging conduit 90 to conduct fluid from the transmission charging delivery passage 84 to the transmission through the gear housing and also permits a transmission scavenging conduit 91 to extend through the gear housing. This protects such conduits from damage that could result from their being mounted in exposed locations, and also causes any leakage from the conduits to remain inside the housing. Furthermore, the entrance to the charging fluid inlet passage 82 is very close to, and directly in line with the outlet from a screen F which is also mounted upon the wall H, so that a charging fluid conduit 92 may be straight and only a few inches long. Likewise, although the torque converter charging fluid conduit 93 must go outside the gear housing, its connection to the pump through the hole H4 is inside the housing, and thus more protected than would otherwise be the case. A portion of the gear housing G provides a sump S to receive scavenged fluid from the passage 87 through the conduit 94, for return to the pump through the screen F. Numeral 95 designates a scavenging fluid conduit which connects the torque converter to the scavenging inlet passage 85 of the scavenging pump subassembly 22.

Other aspects, objects and advantages of this invention can be obtained from a study of the drawings, the disclosure and the appended claims. The foregoing detailed description has been given for clearness of understanding only and no unnecessary limitations should be understood therefrom as modifications will be obvious to those skilled in the art.

We claim:

1. In a hydraulic system which has a plurality of pumps, an improved pump structure comprising:

a pump casing assembly (20) consisting of a plurality of rotary pump casing elements (23–29) disposed in face abutting relationship, said casing elements (23–29) cooperating to define a first pump cavity (54) and a second pump cavity (**55*a*), there being a plurality of manifold passages (82,84,86,87) formed in said casing elements (23–29) for admitting hydraulic fluid to said cavities (54 and 55*a*) and delivering fluid from said cavities, and a series of aligned pump drive shaft openings (56–61) connecting said pump cavities, and said casing elements (23–29) including a fluid delivery end plate (29) and a drive end plate(23**);

a drive shaft (62–63) journalled in said drive shaft openings (56–61) which has an end portion (**62*b*) extending through an opening (56) in the drive end plate (23) and adapted (64**) for operative connection to driving means;

a first rotary pump (76–77) in said first pump cavity (54) and a second rotary pump (80–81) in said second pump cavity (**55*a*), each of said pumps having a pump member (76 or 80) mounted on the drive shaft (62–63), and said manifold passages including a first fluid inlet passage (82) for admitting fluid to the first pump (76–77), a first fluid delivery passage (84) from said first pump (76–77), said first fluid delivery passage (84) having a port in said fluid delivery end plate (29), a second fluid inlet passage (86) for admitting fluid to the second pump (80–81), and a fluid outlet passage (87) from said second pump (80–81), said fluid outlet passage (87) having a port to let fluid out of said casing assembly (20**);

sealing means (88–89) between said casing elements (23–29);

and means (33,44,50,51) detachably securing said casing elements (23–29) in assembled, face abutting relationship.

2. The improved structure of claim 1 in which the pumps (76–77 and 80–81) are gear pumps, a first gear (76 or 80) of each pump is on the drive shaft (62–63), the casing elements (23–29) are provided with aligned idler shaft openings (66–71), idler shaft means (72 and 73) is mounted in the idler shaft openings, and a second gear (77 or 81) of each pump is on the idler shaft means (72–73).

3. The improved structure of claim 1 in which the port of the fluid outlet passage (87) and an entrance to the second fluid inlet passage (86) are both in the fluid delivery end plate (29).

4. The improved structure of claim 3 in which the casing elements (23–29) are pre-assembled into first (21) and second (22) subassemblies, said first subassembly (21) includes the drive end plate (23) and a first set of casing elements (24–26) which define the first pump cavity (54) and which contain the first fluid inlet passage (82) and a first part of the first fluid delivery passage (84) terminating in an open delivery end (**84*a*), and said second subassembly (22) includes the fluid delivery end plate (29) and a second set of casing elements (27 and 28) which contain a second part of the first fluid delivery passage (84) that has an open receiving end in communication with said open delivery end (84*a*), said second set of casing elements (27 and 28) defining the second pump cavity (55*a*) and also containing the fluid outlet passage (87) which terminates at the port of said outlet passage (87) in the fluid delivery end plate (29), and a drive shaft segment (62 and 63) in each subassembly (21 and 22), said segments (62 and 63) including an axially interfitting drive connection (62*a*–63*a***).

5. The improved structure of claim 4 in which first mounting means (50) secures the second subassembly (22) to a support (H), and second mounting means (51) secures the first subassembly (21) to the same support (H) and also provides means detachably securing said two subassemblies (21 and 22) in abutting relationship with said drive connection (**62*a*–63*a***) axially interfitted.

6. The improved structure of claim 3 which includes means (50 and 51) for mounting the casing assembly with the fluid delivery end plate (29) abutting a wall (H) of a housing (G) which communicates directly with a hydraulic power element (T), said wall (H) having a hole (H5) registering with the port of the first fluid delivery passage (84), having a hole (H6) registering with the entrance to the second fluid inlet passage (86), and having a hole (H7) registering with the port of the fluid outlet passage (87), whereby all the fluid connections between the pump structure (20) and the hydraulic power element (T) may be located within said housing (G).

7. The improved structure of claim 1 in which the casing elements (23–29) are pre-assembled into first (21) and second (22) subassemblies, said first subassembly (21) includes the drive end plate (23) and a first set of casing elements (24–26) which define the first pump cavity (54) and which contain the first fluid inlet passage (82) and a first part of the first fluid delivery passage (84) terminating in an open delivery end (**84*a*), and said second subassembly (22) includes the fluid delivery end plate (29) and a second set of casing elements (27 and 28) which contain a second part of the first fluid delivery passage (84) that has an open receiving end in communication with said open delivery end (84*a*), said second set of casing elements (27 and 28) defining the second pump cavity (55*a*) and also containing the fluid outlet passage (87), and a drive shaft segment (62 and 63) in each subassembly (21 and 22), said segments (62 and 63) including an axially interfitting drive connection (62*a* and 63*a***).

8. The improved structure of claim 7 in which the casing elements (23–29) are pre-assembled into first (21) and second (22) subassemblies, said first subassembly (21) includes the drive end plate (23) and a first set of casing elements (24–26) which define the first pump cavity (54) and which contain the first fluid inlet passage (82) and a first part of the first fluid delivery passage (84) terminating in an open delivery end (84*a*), and said second subassembly (22) includes the fluid delivery end plate (29) and a second set of casing elements (27 and 28) which contain a second part of the first fluid delivery passage (84) that has an open receiving end in communication with said open delivery end (84*a*), said second set of casing elements (27 and 28) defining the second pump cavity (55*a*) and also containing the fluid outlet passage (87), and a drive shaft segment (62 and 63) in each subassembly (21 and 22), said segments (62 and 63) including an axially interfitting drive connection (62*a* and 63*a*).

9. The improved structure of claim 1 in which there is an entrance to the second fluid inlet passage (86) in the fluid delivery end plate (29) which includes means for mounting the casing assembly (20) with the fluid delivery end plate (29) abutting a wall (H) of a housing (G) which communicates directly with a hydraulic power element (T), said wall (H) having a hole (H5) registering with the port of the first fluid delivery passage (84), and having a hole (H6) registering with the entrance to the second fluid inlet passage (86) whereby all the fluid connections between the pump structure (20) and the hydraulic power element (T) may be located within said housing (G).

10. In a hydraulic system for a heavy vehicle which has a hydraulic torque converter (C) and a hydraulic transmission (T), an improved pump structure comprising:

a pump casing assembly (20) consisting of a plurality of rotary pump casing elements (23–29) disposed in face abutting relationship, said casing elements (23–29) cooperating to define a torque converter charging pump cavity (53), a transmission charging pump cavity (54), a first scavenging pump cavity (55), and a second scavenging pump cavity (55*a*), there being a plurality of manifold passages (82–87) formed in said casing elements (23–29) for admitting hydraulic fluid to said cavities (53–55*a*) and delivering fluid from said cavities, and a series of aligned pump drive shaft openings (56–61) connecting said pump cavities (53–55*a*), and said casing elements (23–29) including a fluid delivery end plate (29) and a drive end plate (23);

a drive shaft (62–63) journalled in said drive shaft openings (56–61) which has an end portion (62*a*) extending through an opening (56) in the drive end plate and adapted (64) for operative connection to driving means;

a rotary torque converter charging pump (74–75) and a rotary transmission charging pump (76–77) in said respective charging pump cavities (53 and 54), first and second rotary scavenging pumps (78–79 and 80–81) in said scavenging pump cavities (55 and 55*a*) respectively, each of said pumps having a pump member (74,76,78 or 80) mounted on the drive shaft (62–63), and said manifold passages (82–87) including a charging fluid inlet passage (82) for admitting fluid to the two charging pumps (74–75 and 76–77), a torque converter charging fluid delivery passage (83) from said torque converter charging pump (74–75), said torque converter charging fluid passage (83) having a port in said fluid delivery end plate (29), a transmission charging fluid delivery passage (84) from said transmission charging pump (76–77), said transmission charging fluid passage (84) having a port in said fluid delivery end plate (29), a first scavenging fluid inlet passage (85) for admitting fluid from the torque converter (C) to the first scavenging pump (78–79), a second scavenging fluid inlet passage (86) for admitting fluid from the transmission (T) to the second scavenging pump (80–81), and a scavenging fluid outlet passage (87) from said scavenging pumps, said passage (87) having a scavenging fluid outlet port;

sealing means (88–89) between said casing elements;

and means (33,44,50,51) detachably securing said casing elements (23–29) in assembled, face abutting relationship.

11. The improved structure of claim 10 in which the port of the scavenging fluid outlet passage (87) and an entrance to the second scavenging fluid inlet passage (86) are both in the fluid delivery end plate (29).

12. The improved structure of claim 11 in which the casing elements (23–29) are pre-assembled into first (21) and second (22) subassemblies, said first subassembly (21) includes the drive end plate (23) and a first set of casing elements (24–26) which define the two charging pump cavities (53 and 54) and which contain the charging fluid inlet passage (82) and a first part of each of the charging fluid delivery passages (83 and 84) each of which terminates in a respective open delivery end (83*a* or 84*a*), and said second subassembly (22) includes the fluid delivery end plate (29) and a second set of casing elements (27–28) which contain a second part of each charging fluid delivery passage (83 and 84) each of which has an open receiving end in communication with one of said open delivery ends (83*a* or 84*a*), the casing elements of said second subassembly (22) defining the two scavenging pump cavities (55 and 55*a*) and also containing the scavenging fluid outlet passage (87) which terminates at its outlet port in the fluid delivery end plate (29), and a drive shaft segment (62 or 63) in each subassembly (21 or 22), said segments (62 and 63) including an axially interfitting drive connection (62*a*–63*a*).

13. The improved structure of claim 12 in which first mounting means (50) secures the second subassembly (22) to a support (H), and second mounting means (51) secures the first subassembly (21) to the same support (H) and also provides means detachably securing said two subassemblies (21 and 22) in abutting relationship with said drive connection (62*a*–63*a*) axially interfitted.

14. The improved structure of claim 11 which includes means (50 and 51) for mounting the casing assembly (20) with the fluid delivery end plate (29) abutting a wall (H) of a vehicle housing (G) which communicates directly with the hydraulic transmission (T), said wall (H) having a transmission charging fluid hole (H5) registering with the port of the transmission charging fluid passage (84), having a torque converter charging fluid hole (H4) registering with the port of the torque converter charging fluid passage (83), having a scavenging fluid hole (H6) registering with the entrance to the second scavenging fluid inlet passage 86, and having a scavenging fluid hole (H7) registering with the port of the scavenging fluid outlet passage (87), whereby all the fluid connections (90 and 91) between the pump structure (20) and the transmission (T) and a part of the charging connection (93) between the pump structure (20) and the torque converter (C) are located within said housing (G).

15. The improved structure of claim 10 in which the casing elements (23–29) are pre-assembled into first (21) and second (22) subassemblies, said first subassembly (21) includes the drive end plate (23) and a first set of casing elements (24–26) which define the two charging pump cavities (53 and 54) and which contain the charging fluid inlet passage (82) and a first part of each of the charging fluid delivery passages (83 and 84) each of which terminates in a respective open delivery end (83*a* or 84*a*), and said second subassembly (22) includes the fluid delivery end plate (29) and a second set of casing elements (27–28) which contain a second part of each charging fluid delivery passage (83 and 84) each of which has an open receiving end in communication with one of said open delivery ends (83*a* or 84*a*), the casing elements of said second subassembly (22) defining the two scavenging pump cavities (55 and 55*a*) and also containing the scavenging fluid outlet passage (87), and a drive shaft segment (62 or 63) in each subassembly (21 or 22), said segments (62 and 63) including an axially interfitting drive connection (62*a*–63*a*).

16. The improved structure of claim 10 in which the entrance to the second scavenging fluid inlet passage (86) is in the fluid delivery end plate (29) and which includes means (50 and 51) for mounting the casing assembly (20) with the fluid delivery end plate (29) abutting a wall (H) of a vehicle housing (G) which communicates directly with the hydraulic transmission (T), said wall having a transmission charging fluid hole (H5) registering with the port of the transmission charging fluid passage (84), having a torque converter charging fluid hole (H4) registering with the port of the torque converter charging fluid passage (83), and having a scavenging fluid hole (H6) registering with the entrance to the scavenging fluid inlet passage (86), whereby all the fluid connections (90 and 91) between the pump structure (20) and the transmission (T) and a part of the charging connection (93) between the pump structure (20) and the torque converter (C) are located within said housing.

17. The improved structure of claim 10 which includes a direct, short connecting tube (92) between a fluid filter (F) and the entrance opening of the charging fluid inlet passage (82).

18. In a hydraulic system which has a plurality of pumps, an improved pump structure comprising:

a first pump subassembly (21) comprising a plurality of pump casing elements (23–26), a first rotary pump (76–77) in a cavity (54) in said first pump subassembly (21), said first rotary pump (76–77) including a drive shaft segment (62) which has an end portion (62*b*) extending through an end plate (23) of the subassembly (21) and adapted (64) for operative connection to driving means, and said drive shaft segment (62) having an exposed opposite end, a fluid inlet passage (82) for admitting fluid to the first rotary pump (76–77), and a first part of a fluid delivery passage (84) from said pump (76–77) in certain (25–26) of said casing elements which has an open end (84*a*) adjacent the exposed drive shaft end;

a second pump subassembly (22) comprising a plurality of pump casing elements (27–29), a second rotary pump (80–81) in a cavity (55*a*) in said second pump subassembly (22), said second rotary pump (80–81) having a drive shaft segment (63) which has an end adapted to make an axially interfitting drive connection (62*a*–63*a*) with the exposed end of the first drive shaft segment (62), a fluid inlet passage (86) for admitting fluid to the second rotary pump (80–81), a fluid outlet passage (87) from said second rotary pump, and a second part of said fluid delivery passage (84) which is adapted to communicate directly with said open end (84*a*);

first means (50) securing said second pump subassembly (22) to a support (H);

second means (51) securing said first pump subassembly (21) directly to said support (H) and in end abutting relationship to the second pump subassembly (22) with said axially interfitting drive connection (62*a*–63*a*) engaged and with said two parts of the fluid outlet passage (84) in direct communication with one another;

and sealing means (88 and 89) between the abutting ends of said two pump subassemblies (21 and 22).

19. The improved pump structure of claim 18 in which all the fluid passages (84,86 and 87) in the second pump subassembly (22) are open at an end plate (29) of said second pump subassembly (22), and the support (H) is a wall of a housing (G) which has respective holes (H5, H6 and H7) registering with the open ends of said passages (84,86 and 87), whereby all connections (90,91 and 94) to said passages (84,86 and 87) are within said housing (G).

* * * * *